US006669250B1

(12) United States Patent
St. Louis

(10) Patent No.: US 6,669,250 B1
(45) Date of Patent: Dec. 30, 2003

(54) PUSH-PUSH LATCH

(75) Inventor: Matthew St. Louis, Austin, TX (US)

(73) Assignee: St. Louis Designs, Inc., Austin, TX (US)

( * ) Notice: Subject to any disclaimer, the term of this patent is extended or adjusted under 35 U.S.C. 154(b) by 0 days.

(21) Appl. No.: 09/478,932

(22) Filed: Jan. 6, 2000

(51) Int. Cl.[7] ..... E05B 15/02

(52) U.S. Cl. ..... 292/341.11; 292/DIG. 4; 292/73; 292/341.17; 292/304

(58) Field of Search ..... 292/73, 75, 77, 292/122, 197, 198, 304, 203, 222, 224, DIG. 4, 341.11, 341.17

(56) References Cited

U.S. PATENT DOCUMENTS

| | | | | | |
|---|---|---|---|---|---|
| 2,671,928 | A | * | 3/1954 | Bright | 16/138 |
| 3,156,493 | A | | 11/1964 | Griffiths | |
| 3,698,753 | A | * | 10/1972 | Atkinson | 292/247 |
| 3,854,785 | A | * | 12/1974 | Manner | 312/319 |
| 3,885,846 | A | * | 5/1975 | Chuang | 312/306 |
| 3,905,626 | A | * | 9/1975 | Myers | 292/201 |
| 4,025,210 | A | * | 5/1977 | Johnson | 403/240 |
| 4,056,276 | A | * | 11/1977 | Jarvis | 292/201 |
| 4,159,153 | A | * | 6/1979 | Yoshikawa | 312/333 |
| 4,196,924 | A | * | 4/1980 | Iseki | 292/79 |
| 4,215,884 | A | | 8/1980 | Little | |
| 4,657,292 | A | | 4/1987 | Bruck | |
| 4,702,506 | A | | 10/1987 | Iimura | |
| 4,792,165 | A | | 12/1988 | Nishimura | |
| 4,917,416 | A | | 4/1990 | Westphal et al. | |
| 5,004,276 | A | | 4/1991 | Hanley | |
| 5,040,833 | A | | 8/1991 | Brunnert | |
| 5,072,974 | A | | 12/1991 | Henne | |
| 5,217,262 | A | | 6/1993 | Kurosaki | |
| 5,292,158 | A | | 3/1994 | Kurosaki | |
| 5,339,494 | A | * | 8/1994 | Esau | 16/294 |
| 5,346,266 | A | | 9/1994 | Bisbind | |
| 5,401,067 | A | * | 3/1995 | Kurosaki | 292/63 |
| 5,498,039 | A | | 3/1996 | Bivens | |
| 6,044,673 | A | * | 4/2000 | Jefferson | 70/212 |
| 6,045,168 | A | * | 4/2000 | Johnson | 292/216 |
| 6,113,160 | A | * | 9/2000 | Johansson | 292/169 |
| 6,135,511 | A | * | 10/2000 | Smith | 292/156 |
| 6,247,733 | B1 | * | 6/2001 | Weiland | 292/228 |
| 6,250,694 | B1 | * | 6/2001 | Weiland | 292/110 |
| 6,378,916 | B1 | * | 4/2002 | Huang | 292/27 |

* cited by examiner

*Primary Examiner*—Gary Estremsky
(74) *Attorney, Agent, or Firm*—Meyertons, Hood, Kivlin, Kowert & Goetzel, P.C.; Eric B. Meyertons

(57) ABSTRACT

A push-push latch may include a body and a lever arm that is rotatively coupled to the body. A toggle may be coupled to the lever arm and the body. A pin of the toggle may be positioned within a groove in the body of the latch. When the pin is in a first stable position in the groove, an end of the lever arm is positioned away from the body, and the latch is open. When the pin is in a second stable position, the end of the lever arm is near the body, and the latch is closed. A torsion spring, which may be coupled between the body and the lever arm, moves the pin to either the first stable position or the second stable position during use. When the latch is open, applying a closing force to the latch rotates the lever arm towards the body and causes the pin to move from the first position to the second position when the closing force is removed. Applying an opening force to the latch rotates the lever arm towards the body and causes the pin to move from the second stable position to the first stable position when the opening force is removed.

98 Claims, 8 Drawing Sheets

PUSH-PUSH LATCH

BACKGROUND OF THE INVENTION

1. Field of the Invention

The present invention generally relates to a latch device, and more particularly to a push-push latch that has a lever arm rotatively coupled to a latch body. The push-push latch may open or close in response to a force applied to the lever arm of touch latch.

2. Description of the Related Art

A latch may be used to secure one moveable surface relative to another surface. One type of latch is a touch latch, which may also be known as a push-push latch. When an arm of a touch latch is in an open position, pushing the arm of the touch latch may cause the touch latch to move to a closed position. When the arm is pushed again, the arm of the touch latch may move back to the open position. Touch latches may be used as component parts in systems that latch doors, cabinets, drawers, windows, and the like.

A touch latch may have a path formed in a body of the latch. The path may be formed as a groove within the body of the latch. A locking member of the touch latch may be attached to an arm. The arm typically is coupled to a tracing member that follows the path in the latch body. The path typically has two stable points. When the tracing member is located at the first stable point, the touch latch is in an open position. When the tracing member is located at the second stable point, the touch latch is in a closed position. A spring may be positioned within the body to bias the arm away from the body. The spring may force the tracing member to move to one of the two stable points in the path during operation of the touch latch.

In one type of touch latch, the arm is rotationally attached to the body of the touch latch. U.S. Pat. No. 4,215,884, issued to Little, which is incorporated by reference as if fully set forth herein, describes a rotational type of touch latch. The touch latch has an "L" shaped arm. A first leg of the "L" shaped arm traces a path within the body of the touch latch. The second leg of the "L" shaped arm may be contacted by a closure member. When the touch latch is in the open position, pushing the second leg with the closure member rotates the second leg towards the body and causes the first leg to move along the path from the first position to the second position. Pushing the second leg towards the body a second time causes the first leg to move from the second position to the first position and rotates the second leg away from the body of the touch latch. The body of the touch latch may have to be large to accommodate the range of motion of the first leg within the body of the touch latch. Many currently available small, rotational arm touch latches have maximum force ratings of approximately 3 pounds. It is desirable to have a small touch latch that is able to withstand greater than 50 lbs. of force.

In another type of touch latch, an arm of the latch retracts into a body of the latch when the arm moves from an open position to a closed position. U.S. Pat. No. 3,156,493, issued to Griffiths, U.S. Pat. No. 4,702,506, issued to Iimura, and U.S. Pat. No. 5,217,262, issued to Kurosaki, which are incorporated by reference as if fully set forth herein, describes touch latch mechanisms that have retractable arms. When a touch latch with a retractable arm is in an open position, pushing the arm may cause the arm to retract within the body of the latch. The movement of the arm may cause a tracing member to follow a path from a first stable position to a second stable position. Pushing the latch a second time may cause the tracing arm to travel the path from the second stable position to the first stable position so that the arm extends from the body of the touch latch.

In another type of touch latch, an arm of the latch is flexible. One end of the arm may be fixed in a set position. The tracing member may be located at an opposite end of the arm. The path that the tracing member follows may be located on a movable member. Closing the movable member against the arm causes the tracing member to follow the path so that the tracing member is located at a stable position of the path when the movable member is in a closed position. The tracing member holds the movable member in the closed position. Pushing the movable member a second time causes the tracing member to move away from the stable position so that the movable member is released. U.S. Pat. No. 4,657,292, issued to Bruck describes a touch latch mechanism having a flexible, fixed position arm.

Touch latches may be used to hold a closure member in a closed position. In some applications, such as in aircraft applications and marine applications, the touch latch may have to resist large forces exerted against the touch latch by shifting contents within the closure. Many currently available touch latches are not able to withstand large forces exerted against the touch latch without releasing the closure member. Large forces exerted against the touch latch may also damage or destroy a touch latch.

Sometimes a user of a touch latch may try to improperly open a storage compartment that is latched with a touch latch. For example, a user may pull outwardly upon the door of a storage compartment, instead of pushing the door inwards. Many currently available touch latches are not able to withstand outward pulling forces exerted against a touch latch without releasing the closure member and without damaging the touch latch.

The design of some touch latches may allow the touch latch to open if the spring that biases the arm away from the body of the touch latch breaks. It is desirable to have a touch latch that will remain in a closed position if the spring that guides the tracing member along should break during use.

SUMMARY OF THE INVENTION

The problems outlined above may in large part be solved by a latch system that may include a push-push latch and a catch. The push-push latch may be small in size, yet the push-push latch may have a large strength to size ratio. The push-push latch may include an arm that is rotationally attached to a body of the latch. An end of the arm may engage the catch when the push-push latch is in a closed position.

In an embodiment, the push-push latch may have a body with a groove formed in an inner surface of the body. A lever arm may be rotatively coupled to the body at a pivot connection. One arm of a torsion spring may contact the body of the latch. A second arm of the torsion spring may contact the lever arm. The force that the torsion spring applies to the push-push latch will tend to rotate the lever arm away from the body of the latch. One end of a toggle may be pivotally coupled to the lever arm between an end of the lever arm and the pivot connection. A second end of the toggle may have a tracing member that is positioned within the groove in the body of the latch. The groove may have two stable positions. When the tracing member is in the first stable position, the push-push latch is in an open position. When the tracing member is in the second stable position, the push-push latch is in a closed position. When the push-push latch is in the closed position, an end of the lever arm may be held by the catch of the latch system.

When the lever arm is rotated away from the body as far as the toggle arm will allow, the tracing member is in the first position, and the lever arm is in an open position. When the lever arm is rotated toward the body by a closing force, the tracing member follows the path of the groove towards the second position. If the closing force is not large enough to move the tracing member from the first stable position to the second stable position, the torsion spring will tend to force the lever arm away from the body to return the lever arm to the open position when the closing force is removed. If the closing force is large enough to move the tracing member from the first stable position to the second stable position, the tracing member will move to the second stable position when the closing force is removed from the lever arm. When the tracing member is in the second stable position, the lever arm is in a closed position. An end of the lever arm may be held by the catch when the lever arm is in the closed position. The end of the lever arm may be a roller that is rotationally connected to the lever arm.

When the lever arm is in the closed position, applying an opening force to the lever arm that pushes the lever arm towards the body of the push-push latch may cause the tracing member to follow a path that moves the tracing member from the first stable position to the second stable position. If the opening force is not large enough to move the tracing member from the second stable position to the first stable position, the tracing member will return to the second stable position when the opening force is removed from the lever arm. The lever arm will remain in the closed position, and the end of the lever arm will not be released from the catch. If the opening force is large enough to move the tracing member from the second stable position to the first stable position, the tracing member will move to the first stable position when the opening force is removed. The end of the lever arm will be released from the catch, and the lever arm will move to the open position.

Advantages of the push-push latch include that the latch may be small, light weight, and strong. The small size of the push-push latch may allow the latch to be coupled to space restricted surfaces and confined regions that were not previously usable for latching mechanisms. The small size, light weight and high strength characteristics of the push-push latch may make the push-push latch ideal for use in space, aircraft, and marine applications. The push-push latch may be able to withstand large forces that attempt to improperly open the latch without breaking the latch, and without opening the latch. Forces that try to improperly open the push-push latch may result in the application of tension to the toggle of the latch. The toggle, the connection between the toggle and the body, and the connection between the toggle and the lever arm may be made of materials that have good resistance to failure due to tension applied through the toggle. A push-push latch that is less than 1⅛"×¾"×⅜" when in a closed position (less than 1½"×¾"×⅜" when in an open position) may withstand outward pulling force in excess of 90 pounds of force without releasing the push-push latch from the closed position and without damaging the latch. Changing the materials and/or size of a push-push latch may allow the push-push latch to withstand outward pulling force in excess of 150 pounds of force without releasing the push-push latch from a closed position and without damaging the latch.

Another advantage of the push-push latch is that the latch will not release if the torsion spring breaks while the latch is in a closed position. A push-push latch may be used in a system wherein items are stored within a closure, and a door of the closure may be held in a closed position by the latch. If the torsion spring of the push-push latch happens to break while the push-push latch is in a closed position, the latch will not release the door of the closure. The push-push latch will prevent the contents of the closure from discharging from the closure even if the torsion spring of the latch breaks. In other words, the push-push latch will still function even if the push-push latch should partially fail.

Another advantage of the push-push latch is that the latch may be formed of materials that are strong, hard, non-corrosive, and nonflammable. The moving parts of the push-push latch, and the parts of the latch that come into contact with the moving parts, may be made of materials that inhibit galling. The use of non-galling materials may allow the push-push latch to be operated without the need for lubrication of the moving parts of the latch and without excessive wear to the parts of the latch.

A further advantage of the push-push latch is that no visible hardware is present on exterior surfaces of a closure when the latch is used as a part of a latching system for the closure. Further advantages of the push-push latch are that the latch may be sturdy, durable, simple, efficient, and reliable; yet the latch may also be easy to manufacture, install, maintain and use.

BRIEF DESCRIPTION OF THE DRAWINGS

Further advantages of the present invention will become apparent to those skilled in the art with the benefit of the following detailed description of embodiments and upon reference to the accompanying drawings in which.

Figure 1:
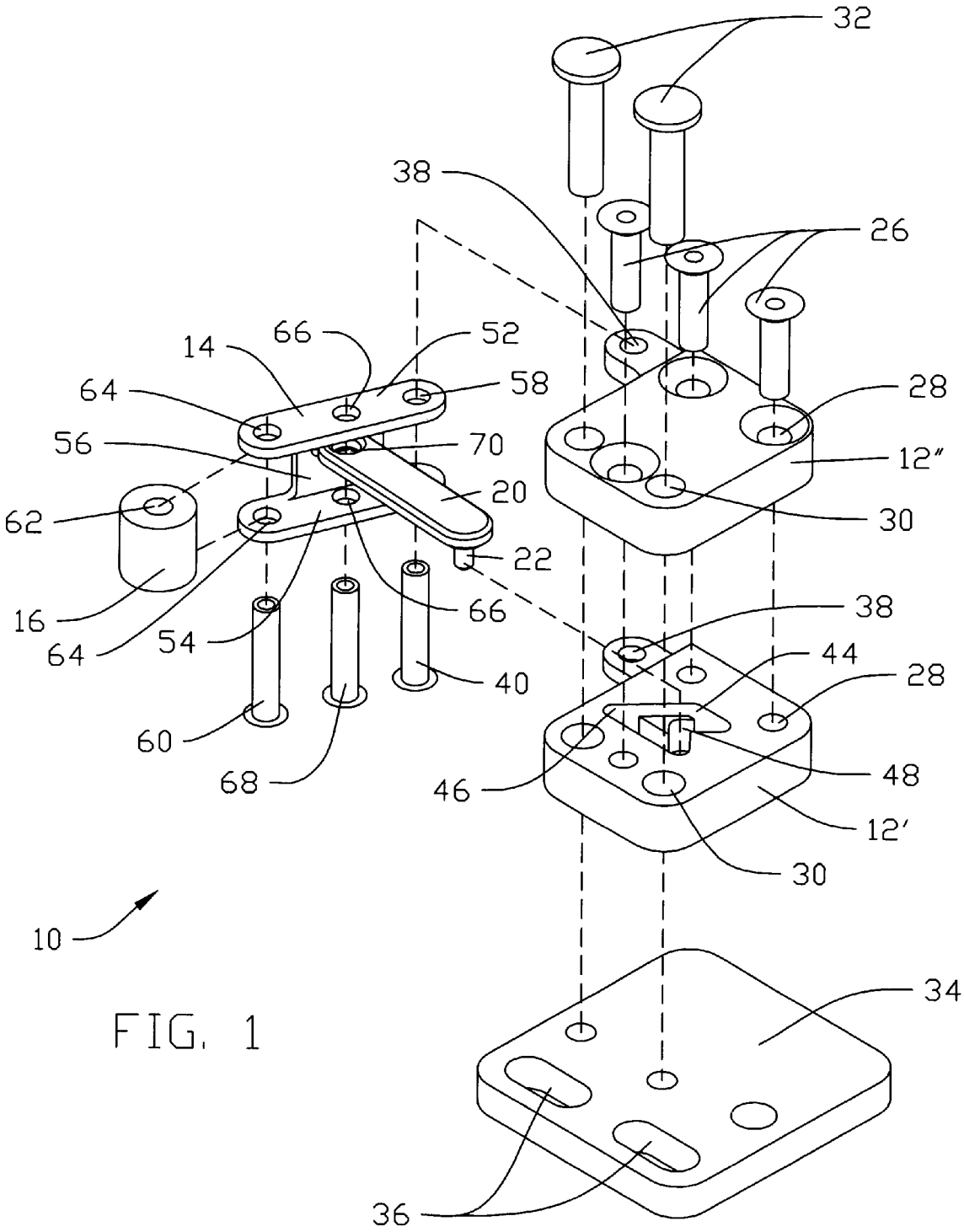
FIG. 1 is an exploded view of a push-push latch without a torsion spring and without a coil spring.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but to the contrary, the intention is to cover all modifications, equivalents and alternatives falling within the spirit and scope of the present invention as defined by the appended claims.

DESCRIPTION OF THE PREFERRED EMBODIMENTS

Referring to the drawings, a push-push latch is designated generally as 10. Uses for a push-push latch 10 include, but are not limited to, latching doors, cabinets, drawers, storage compartments, and the like. A push-push latch 10 may also be part of an activation mechanism in a storage device that stores an accessory in an out of the way location when the storage device is in a closed position, and brings the accessory to hand when in the storage device is in an open position. The accessory may be a tray, a telephone, a personal viewing device, or other device that a user desires to store in an out of the way location when not in use. The push-push latch 10 may be small, light weight, and able to withstand large applied forces without breaking.

Figure 2A:
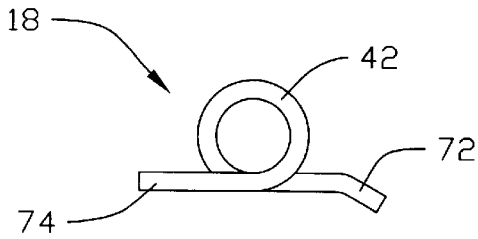
FIGS. 2*a* and 2*b* show elevational views of a torsion spring that may be used to force a lever arm of a push-push latch away from a body of the latch.
Figure 3A:
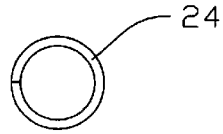
FIGS. 3*a* and 3*b* show elevational views of a coil spring that may be positioned between a lever arm and a toggle of a push-push latch.
Figure 2B:
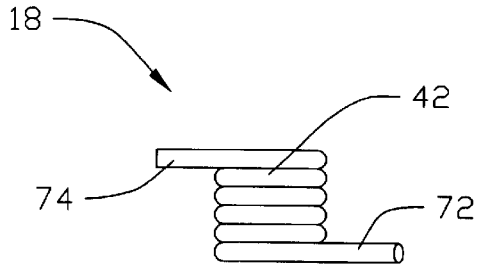
Figure 3B:
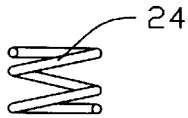

The push-push latch 10 may include first body member 12', second body member 12", lever arm 14, roller 16, torsion spring 18, toggle 20 having pin 22, and coil spring 24. FIG. 1 shows an exploded view of the push-push latch 10 without the torsion spring 18 and without the coil spring 24. The torsion spring 18 is shown in FIGS. 2*a* and 2*b*, and the coil spring 24 is shown in FIG. 3*a* and FIG. 3*b*. The materials used to form the component parts of the push-push latch 10 may be purchased from the McMaster-Carr Supply Company.

The first body member 12' and the second body member 12" may be joined together with fasteners 26 to form body 12 of the push-push latch 10. The first body member 12' and the second body member 12" may have holes 28. Fasteners 26 may be positioned through the holes 28 to join the body members 12', 12" together. Suitable fasteners 26 may include, but are not limited to, rivets, screws, and bolts. If the fasteners 26 are threaded, the holes 28 in the first body member 12' or the second body member 12" may have corresponding threading so that the first body member is securely fastened to the second body member when the push-push latch 10 is assembled.

The first body member 12' and the second body member 12" may include mount holes 30. Suitable fasteners 32 may be positioned in the mount holes 30 so that the push-push latch 10 may be removably attached to mounting plate 34 or to a mounting surface (not shown). The push-push latch 10 may be attached to the mount plate 34 or mounting surface by screw rivets, or other type of fastening system. Fasteners (shown in FIGS. 6 and 7) may be positioned in holes 36 in the mounting plate 34 to attach the mounting plate to a mounting surface.

The first body member 12' and the second body member 12" may also include pivot holes 38. Rivet 40 positioned through pivot mount holes 38 may be used to rotationally couple the lever arm 14 to the body 12 of the push-push latch 10. The rivet 40 may also pass through coil 42 of the torsion spring 18.

Figure 4:
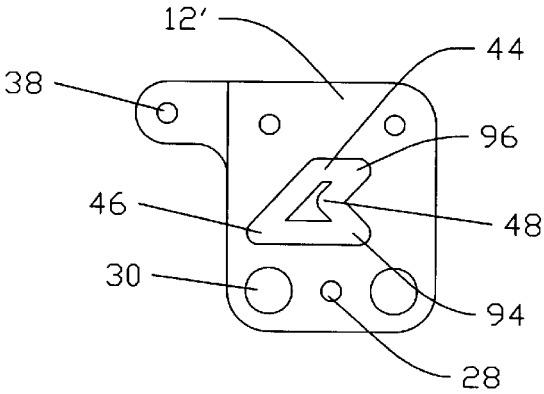
FIG. 4 is an elevational view of a first body member showing an endless groove formed in a surface of the first body member.

The first body member 12' may include endless groove 44. FIG. 4 shows an elevational view of the first body member 12'. The groove 44 may include first stable position 46 and second stable position 48. The groove 44 defines a path that the pin 22 of the toggle 20 travels when the push-push latch 10 is opened and closed. When the pin 22 is in the first stable position 46, the push-push latch 10 is open. When the pin 22 is in the second stable position 48, the push-push latch 10 is closed. The first body member 12' may be made of a material that has a high resistance to galling caused by the pin 22 traveling within the groove 44. The toggle 20 may be made of stainless steel, such as 410 stainless steel. The toggle 20 may be heat treated after being formed to increase the strength of the toggle. The first body member 12' may be made of an aluminum bronze alloy, such as Alloy 954 aluminum bronze. Alloy 954 aluminum bronze has a high resistance to galling.

Figure 5:
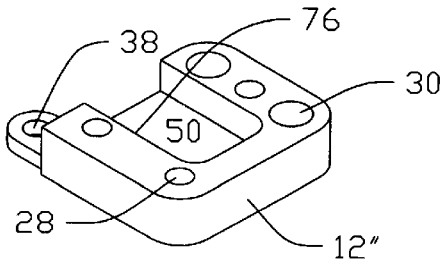
FIG. 5 is a perspective view of a second body member showing a channel in a surface of the second body member.

As shown in FIG. 5, the second body member 12" may include channel 50. The channel 50 may have a length, width and depth that permits the toggle 20 to move within the channel when the push-push latch 10 is assembled. The second body member 12" may be made of aluminum that has an anodized finish.

FIG. 1 shows the lever arm 14. The lever arm 14 may include upper member 52, lower member 54, and back 56. Rivet 40 may be positioned through first set of holes 58 (only one shown), through pivot holes 38 in the body 12, and through the coil 42 of the torsion spring 24 (shown in FIG. 2*a*) to rotationally couple the lever arm 14 to the body. Rivet 60 may be passed through second set of holes 64 in the upper and lower surfaces 52, 54 of the lever arm 14, and through hole 62 in the roller 16 to rotationally couple the roller to the lever arm 14. Rivet 68 may be positioned through third set of holes 66, through the coil spring 24 (shown in FIG. 3*a*), and through hole 70 in the toggle 20 to pivotally couple the toggle to the lever arm 14. The coil spring 24 may be positioned between the upper member 52 and the toggle 20. The coil spring 24 may exert a force against the lever arm 14 and the toggle 20 that inhibits vertical motion of the toggle and helps to keep the pin 22 seated within the groove 44 of an assembled push-push latch 10.

The third set of holes 66 may be located between the first and second set of holes 58, 64. The roller 16 may be made of a plastic material, such as black acetal plastic. The rivets 40, 60, 68 may be made of zinc plated, 1006 carbon steel. Fasteners other than rivets may be used to attach the body 12, the toggle 20 and the roller 16 to the lever arm 14. Other types of fasteners may include, but are not limited to nuts and bolts, screws, and bolts. The lever arm 14 may be made of aluminum that has an anodized finish.

As shown in FIG. 2*a* and FIG. 2*b*, the torsion spring 18 may include the coil 40, first end 72 and second end 74. Rivet 40 may be passed through the coil 44 during assembly of the push-push latch 10. The first end 72 of the torsion spring may be positioned against channel wall 76 of the second body member 12". The second end 74 of the torsion spring 18 may be positioned against back 56 of the lever arm 14. The torsion spring 18 may provide a force against the lever arm 14 that tends to rotate the lever arm away from the body 12 of the push-push latch 10. The torsion spring 18 may be formed from 17-7 stainless steel.

The toggle arm 20 may have integrally formed pin 22 near an end of the toggle. Alternately, a pin 22 may be securely attached to a toggle 20 near an end of the toggle. When the push-push latch 10 is assembled, the pin 22 is positioned in the groove 44, and rivet 68 passes through the toggle hole 70 to pivotally couple the toggle 20 to the lever arm 14. The toggle 20 limits the range of motion of the lever arm 14. When the lever arm 14 rotates, the rotation of the lever arm moves the toggle 20, which in turn moves the pin 22. The pin 22 travels the path of the groove. When the pin is in the first stable position 46, the roller 16 is positioned as far away from the body 12 as the toggle 20 will allow. When the pin 22 is in the first stable position 46, the push-push latch is open. When the pin 22 is in the second stable position 48, the roller 16 is located near the body 12 of the push-push latch 10. When the pin 22 is in the second stable position 48, the push-push latch 10 is closed.

To assemble an embodiment of the push-push latch 10, the pin 22 of the toggle 20 is placed in the groove 44 of the first body member 12'. The second body member 12" is fastened to the first body member 12' by fasteners 26. The first end 72 of the torsion spring 18 is inserted in the channel 50 of the second body member 12" against the wall 76 of the channel. The second end 74 of the torsion spring 18 is positioned against the back 56 of the lever arm. The set of holes 58 on the lever arm 14, and the coil 42 of the torsion spring 18 are aligned with the pivot holes 38 of the body 12. The rivet 40 is positioned through the hole (not shown) in the lower member 54 of the lever arm 14, through hole 38 in the first body member 12', through the coil 42 of the torsion spring 18, through the hole 38 in the second body member 12", and through the hole 58 in the upper member 52 of the lever arm. The rivet 40 is set to rotationally couple the lever arm 14 to the body 12. The lever arm 14 is then rotated towards the body 12 until the toggle hole 70 aligns with the set of holes 66 in the lever arm. The rivet 68 is inserted through the lower member 54 of the lever arm 14, through the toggle hole 70, through the coil spring 24 and through the upper member 56 of the lever arm. The rivet 68 is set so that the rivet pivotally connects the toggle 20 to the lever arm 14. The roller 16 is aligned with the set of holes 64, and the rivet 60 is positioned through the set of holes in the lever arm 14 and through hole 62 in the roller 16. The rivet 60 is set to connect the roller arm 16 to the lever arm 14.

Figure 6:
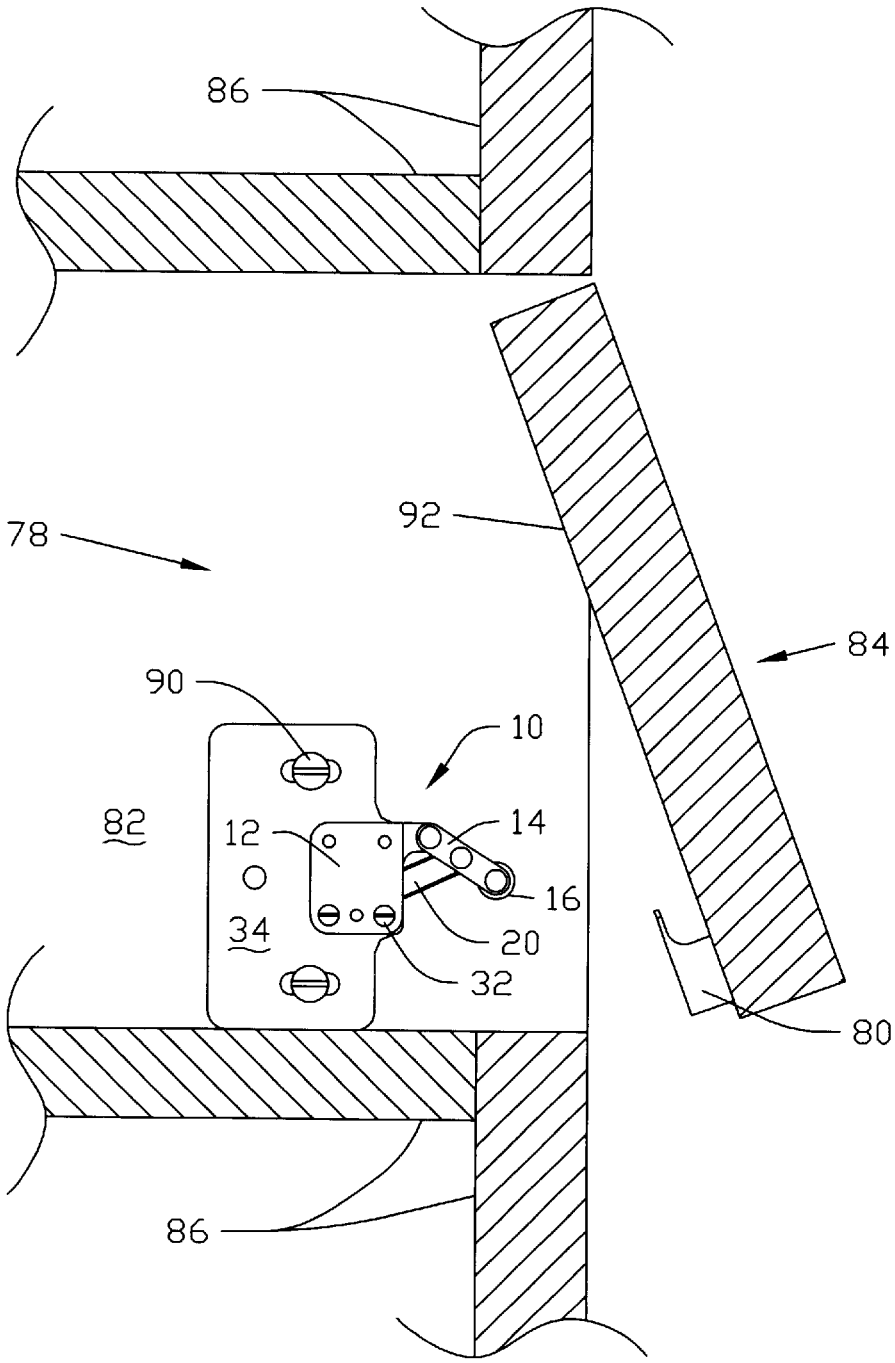
FIG. 6 is a cross sectional view of a closure that has a push-push latch, wherein the push-push latch is in an open position.

FIG. 6 shows an embodiment of a latch system mounted within a cabinet 78. The latch system may include a push-push latch 10, a mounting plate 34, and catch 80. The cabinet may include mount surface 82, door 84, walls 86, and a hinge (not shown). The mounting plate 34 may be attached by fasteners 90 to the mount surface 82. The catch 80 may be attached by fasteners (not shown) to surface 92 of the door 84. The door 84 may be attached to a wall 86 of the cabinet 78 by the hinge.

Referring to FIG. 6 and to FIG. 4, when the push-push latch 10 is in an open position (as shown in FIG. 6), the pin 22 of the toggle 20 is located at the first stable position 46 (shown in FIG. 4). When a closing force is applied to the door 84, the surface 92 of the door contacts the roller 16 of the push-push latch 10. The closing force rotates the lever arm 14 towards the body 12. The rotation of the lever arm 14 towards the body 12 moves the toggle 20 within the body 12. The pin of the toggle 20 moves along the groove 44. The pin moves from the first stable position 46 toward position 94. If the closing force is not large enough to close the door 84, the torsion spring of the push-push latch 10 will rotate the lever arm 14 away from the body 12 and return the pin to the first stable position 46 when the closing force is removed from the door 84. If the closing force is large enough to close the door 84, the pin will move to position 94, and when the closing force is removed from the door, the torsion spring 18 will rotate the lever arm 14 away from the body 12. The movement of the lever arm 14 away from the body 12 will cause the pin to move from position 94 to the second stable position 48. When the pin is in the second stable position 48, the connection between the toggle 20 will prevent the lever arm from rotating away from the body 12 of the push-push latch 10. When the door 84 is closing, the roller 16 will roll along the surface 92 of the door 84. The roller 16 will be positioned beneath the catch 80 when the door 84 is closed. When the pin is in the second stable position 48, the push-push latch 10 is in a closed position.

Figure 7:
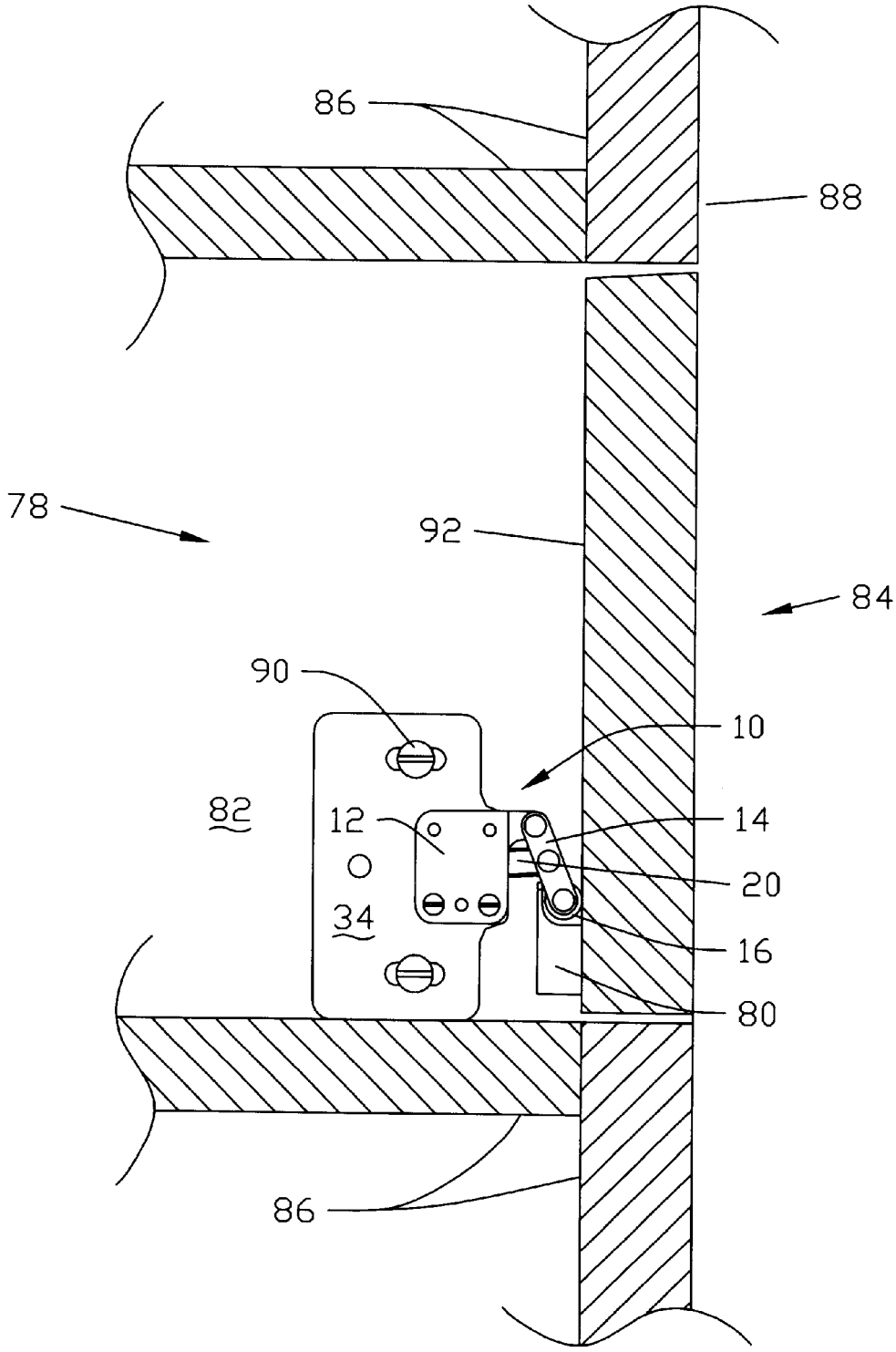
FIG. 7 is a cross sectional view of a closure that has a push-push latch, wherein the push-push latch is in a closed position.

FIG. 7 shows the push-push latch 10 when the pin is in the second stable position. The roller 16 is held by the catch 80. If a force is applied against surface 92 of the door 84 that would move the door away from the closed position, the latch system will hold the door in the closed position. Such a force could be transmitted to the door 84 by shifting articles that are stored within the cabinet, or by a user who tries to improperly open the door by pulling the door away from the latching system. The force transmitted against the door will be transmitted through the catch 80 to the push-push latch 10 as a tension force acting through the toggle 20.

Should the torsion spring 18 happen to fail when the push-push latch 10 is in a closed position, the lever arm 14 will not automatically move to the open position. The torsion spring 18 of the push-push latch 10 is unlikely to fail, but if it does fail when the latch is in a closed position, the latch may prevent items stored within the cabinet 78 from being inadvertently discharged out of the cabinet 78.

Referring to FIG. 7 and FIG. 4, the door 84 may be released from the closed position if the door is pushed toward the push-push latch 10 with an opening force. When an opening force is applied to the door 84, the opening force causes the lever arm 14 to initially move toward the body 12. The movement of the lever arm 14 toward the body causes the toggle 20 and pin to move. The pin will move from the second stable position 48 toward position 96. If the opening force is not large enough to open the door 84, the torsion spring will cause the lever arm 14 to rotate away from the body 12 when the opening force is removed from the door. The pin will return to the second stable position 48 and the door 84 will remain in a closed position. If the opening force is large enough to open the door 84, the pin will move to position 96, and when the opening force is removed from the door, the torsion spring will rotate the lever arm 14 away from the body 12. The rotation of the lever arm 14 away from the body 12 will cause the pin 22 to move from position 96 to the first stable position 46. When the pin is in the first stable position 46, the toggle 20 will prevent further rotation of the lever arm 14 away from the body 12. The rotation of the lever arm 14 away from the body when the pin is traveling from position 96 to the first stable position 46 will cause the door 84 to open. When the pin 22 is located in the first stable position 46, the door 84 is open.

Figure 8:
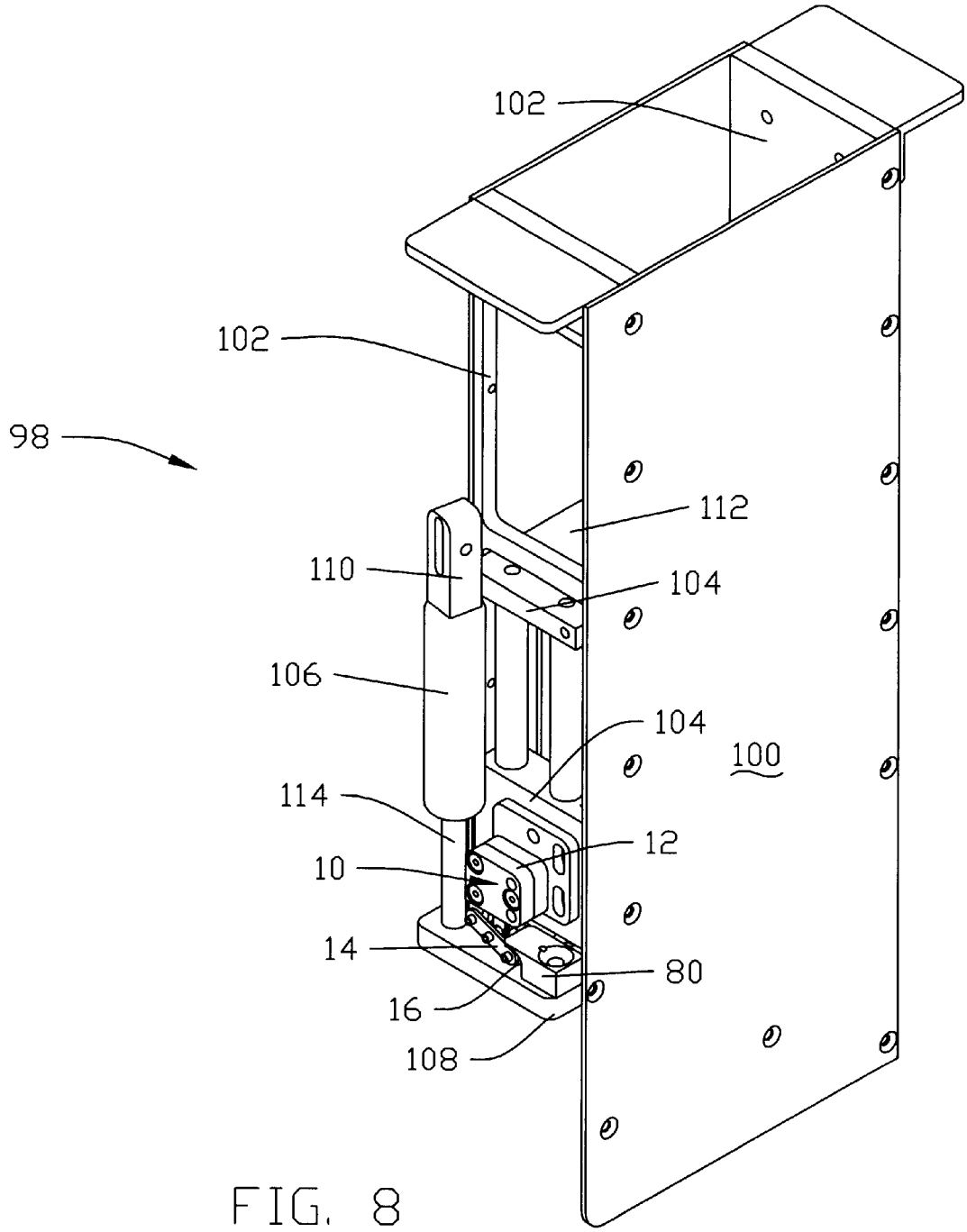
FIG. 8 is perspective view of a storage device that uses as a touch latch as part of an activation mechanism.

FIG. 8 shows an embodiment of storage device 98 that uses a push-push latch 10 as part of an activation mechanism that opens and closes the storage device. The storage device 98 shown in FIG. 8 is in a closed position. The storage device 98 may include mounting plate 100, housing 102, platform 104, drive mechanism 106, drive mechanism mounting plate 108, pulley block 110, and catch 80. The platform 104 may be coupled to the push-push latch 10. The platform 104 may be configured to move vertically within the housing 102. When the platform 104 moves within the housing 102, the push-push latch 10 moves with the platform. The drive mechanism may be a gas spring, spring reel or similar device. The drive mechanism 106 may be coupled to drive mechanism mounting plate 108. The drive mechanism mounting plate 108 is stationary. The drive mechanism 106 shown in FIG. 8 is a gas spring in a compressed configuration. The catch 80 may also be coupled to the drive mechanism mounting plate 108. A cable (not shown) is threaded in the pulley block 110. One end of the cable may be attached to the drive mechanism mounting plate 108. The other end of the cable may be attached to the platform 104.

Figure 8A:
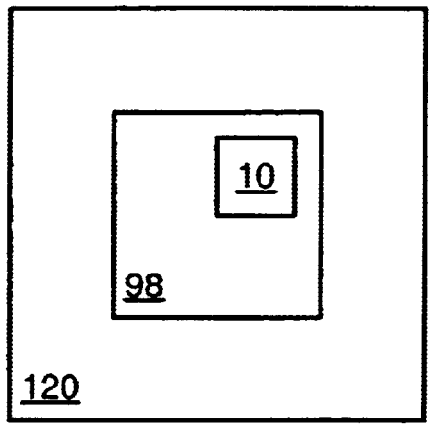
FIG. 8A is a schematic diagram of a storage device in an aircraft cabin.
Figure 8B:
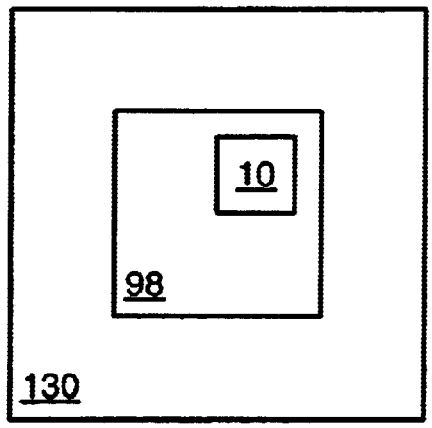
FIG. 8B is a schematic diagram of a storage device in a boat cabin.

Storage devices are often needed in areas where there is a limited amount of free space. Such areas may include, but are not limited to, aircraft cabins and boat cabins. FIG. 8A shows a schematic diagram of storage device 98 including push-push latch 10 in an aircraft cabin. FIG. 8B shows a schematic diagram of storage device 98 including push-push latch 10 in a boat cabin 130.

An object (not shown) that is to be stored within the storage device 98 may be placed on upper surface 112 of the platform 104. The object may be a telephone or other type of device that a user desires to store in an out of the way position when the object is not in use. To activate the storage device 98 to bring a stored object to the user, the user pushes down on an upper surface of the object. Pushing down on the object will cause a force to be transmitted to the push-push latch 10. The force will rotate the lever arm 14 toward the body 12 of the push-push latch 10. When the force is released, the lever arm 14 will rotate away from the body 12, and the roller 16 of the push-push latch 10 will be released from the catch 80. Arm 114 of the drive mechanism 106 will extend when the roller 16 is released from the catch 80. The extension of the arm 114 will cause the cable to raise the platform 104. Raising the platform 104 will bring the object to the user.

To store the object in the out of the way position, the user places the object on the platform 104 and pushes the platform downward with a closing force exerted against the top of the object. The closing force will compress the drive mechanism 106 and lower the platform 104. The roller 16 will contact the drive mechanism mounting plate 108, and will be positioned beneath the catch 80. When the closing force is released, the push-push latch 10 will be in a closed position such that the roller 16 holds catch 80. The object will stay in the out of the way position until the push-push latch 10 is activated again.

Figure 9:
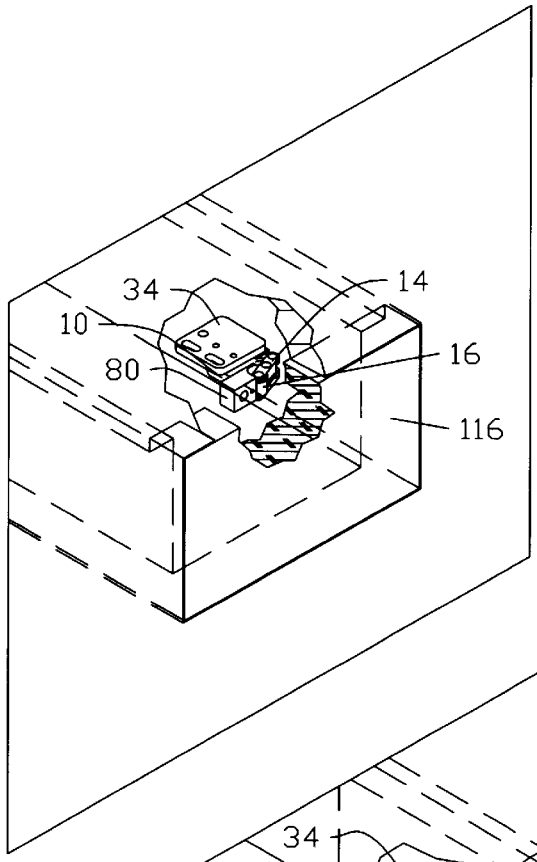
FIG. 9 is a cut-away view of a drawer in a closed position.
Figure 10:
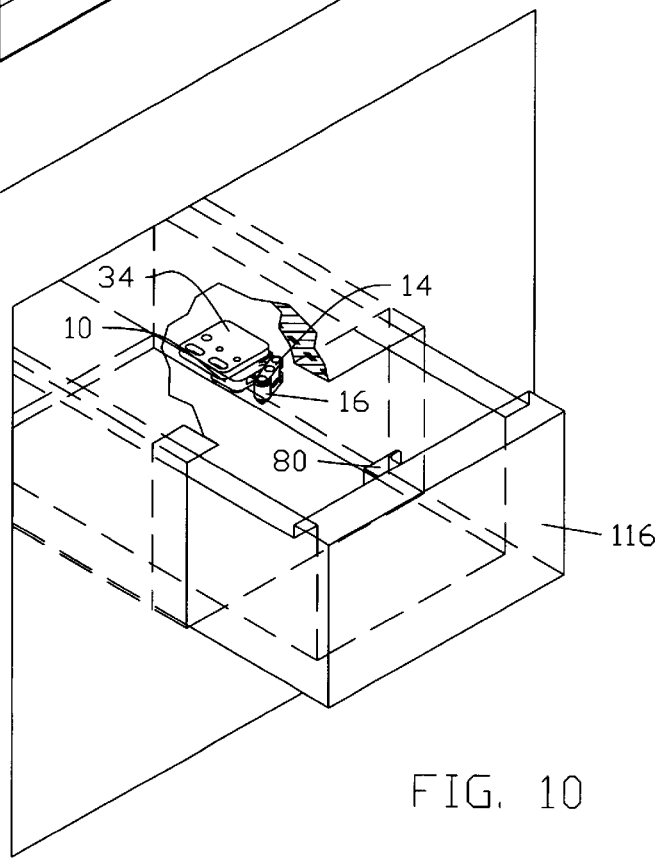
FIG. 10 is a cut-away view of a drawer in an open position.

FIG. 9 and FIG. 10 show a push-push latch 10 used in a drawer system. The push-push latch 10 may be mounted to a latch plate 34. The latch plate 34 may be mounted to an inside surface of drawer support structure. The catch 80 may be mounted to the inside surface of drawer 116. When the drawer is closed, the catch securely holds the drawer against the drawer support structure. To open the drawer 116, a user applies an opening force to the drawer 116 that moves the drawer towards the push-push latch 10. The inner surface of the drawer 116 will contact the roller 16 and rotate the lever arm 14 towards the body of the latch. When the user stops applying the opening force, the torsion spring of the push-push latch 10 will rotate the lever arm 14 away from the body and the torsion spring will open the drawer 116. The user may that grasp the drawer 116 and fully open the drawer. FIG. 10 shows the drawer 116 in an open position.

To close the drawer 116, the user applies a closing force to the drawer to move the drawer towards the push-push latch 10. The roller 16 will contact the inside surface of the drawer 116, and the drawer will move the lever arm 14 toward the body of the push-push latch 10. When the user stops applying the closing force, the torsion spring of the push-push latch 10 will rotate the lever arm 14 away from the body of the latch to the closed position. The roller 16 will hold the catch 80 and prevent the drawer from inadvertently opening.

Figure 11:
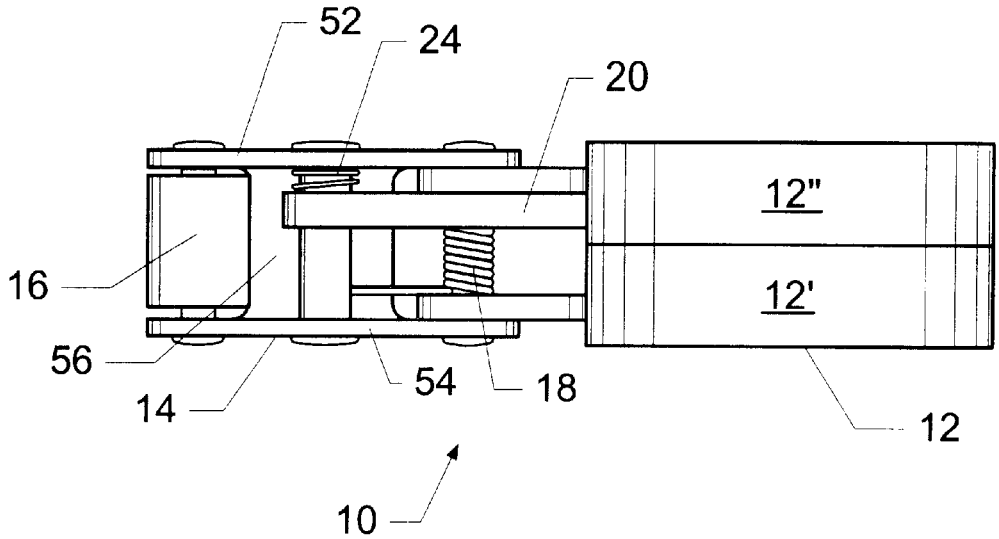
FIG. 11 depicts a front view of the push-push latch in an open position.

FIG. 11 depicts a front view of the latch in an open position. Lever arm 14 may be rotatively coupled to body 12. Toggle 20 may be pivotally coupled to lever arm 14. Torsion spring 18 may be coupled to lever arm 14 and body 12. Coil spring 24 may be placed between toggle 20 and upper member 52 of lever arm 14.

Further modifications and alternative embodiments of various aspects of the invention will be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as examples of embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims.

What is claimed is:

1. A latch comprising:

a body;

a path formed in or coupled to the body, the path having at least a first position and a second position, wherein the path comprises a continuous loop groove formed in the body;

a lever arm pivotally coupled to the body;

a toggle pivotally coupled to the lever arm;

a tracing member coupled to the toggle, the tracing member configured to couple the toggle to the body, and wherein a portion of the tracing member is configured to follow the path during use; and a torsion spring coupled to the lever arm and to the body, the torsion spring configured to rotate the lever arm away from the body;

wherein a closing force applied to the lever arm when the lever arm is in an open position rotates the lever arm toward the body and moves the tracing member away from the first position so that the tracing member moves to the second position when the closing force is removed from the lever arm.

2. The latch of claim 1, wherein an opening force applied to the lever arm when the lever arm is in a closed position rotates the lever arm toward the body and moves the tracing member away from the second position so that the tracing member moves to the first position when the opening force is removed from the lever arm.

3. The latch of claim 1, wherein the toggle and the tracing member are configured to inhibit the lever arm from rotating to the open position from the closed position when an outward force is applied to the lever arm.

4. The latch of claim 1, further comprising a roller rotationally coupled to the lever arm near an end of the lever arm.

5. The latch of claim 1, wherein the path comprises an endless groove in the body, wherein the tracing member comprises a pin, and wherein a portion of the pin is configured to fit within the groove.

6. The latch of claim 5, wherein the body comprises a first member and second member, and wherein the groove is formed in the first member.

7. The latch of claim 6, wherein the first member comprises aluminum bronze.

8. The latch of claim 5, further comprising a rivet configured to couple the toggle to an upper member of the lever arm, and a spring placed on the rivet between the toggle and the upper member of the lever arm such that the pin remains within the groove.

9. The latch of claim 1, wherein fastening means couple the lever arm to the body, and the toggle to the lever arm.

10. The latch of claim 9, wherein the fastening means comprises rivets.

11. The latch of claim 1, wherein the latch is a touch latch able to withstand an outward pulling force in excess of 90 pounds of force without releasing the latch from a closed position and without damaging the latch.

12. The latch of claim 1, wherein the latch is a touch latch.

13. The latch of claim 1, wherein the latch is configured to be used in an aircraft cabin.

14. The latch of claim 1, wherein the latch is configured to inhibit the lever arm from rotating from a closed position to an open position when an outward force is applied to the lever arm even if the torsion spring has failed.

15. The latch of claim 1, wherein the latch is a touch latch able to withstand an outward pulling force in excess of 90 pounds of force without releasing the latch from a closed position and without damaging the latch, and wherein the latch is configured to inhibit the lever arm from rotating from a closed position to an open position when an outward force is applied to the lever arm even if the torsion member has failed.

16. The latch of claim 1, wherein the latch is an aircraft cabin latch, and wherein the latch is configured to latch a storage device in an aircraft during use.

17. The latch of claim 1, wherein the latch is an aircraft cabin latch, wherein the latch is configured to latch a storage device in an aircraft during use, and wherein the latch is a touch latch.

18. The latch of claim 1, wherein the latch is configured to be used in a boat.

19. A system for latching and unlatching two members, comprising:

a first member, wherein the first member comprises a stationary portion of a storage device;

a second member, wherein the second member comprises a platform of the storage device, and wherein the first member and the second member are configured to move relative to each other;

a catch coupled to the first member; and a latch coupled to the second member, the latch comprising:

a body;

a path formed in or coupled to the body, the path having at least a first position and a second position;

a lever arm pivotally coupled to the body, said lever arm having an end;

a toggle pivotally coupled to the lever arm between the end and the body;

a tracing member coupled to the toggle, wherein the tracing member is configured to follow the path during use, and wherein the tracing member couples the toggle to the body; and a torsion member coupled to the body and to the lever arm, the torsion member configured to rotate the lever arm away from the body;

wherein the latch is configured to open and close the storage device, and wherein the platform of the storage device can be raised to an open position when the latch is open;

a drive mechanism configured to raise the platform when the latch is open;

wherein the catch is releasably coupled to the end of the lever arm when the latch is closed, and wherein the latch closes when a force exerted on the lever arm by the first member rotates the lever arm toward the body and moves the tracing member away from the first position such that the tracing member moves to the second position when the force is no longer applied to the lever arm; and wherein the latch is a touch latch able to withstand an outward pulling force in excess of 90 pounds of force without releasing the latch from a closed position and without damaging the latch.

20. The system of claim 19, wherein the latch opens when an opening force exerted on the lever arm by the first member rotates the lever arm toward the body and moves the tracing member from the second position such that the tracing member moves to the first position when the opening force is no longer applied to the lever arm.

21. The system of claim 19, wherein the toggle and the tracing member are configured to inhibit a closed latch from opening when an outward force is applied to the first member.

22. The system of claim 19, wherein the torsion member comprises a torsion spring.

23. The system of claim 19, wherein the end of the lever arm comprises a roller that is rotationally coupled to the lever arm.

24. The system of claim 19, wherein the path comprises a continuous loop groove in the body, wherein the tracing member comprises a pin, and wherein a portion of the pin is configured to fit within the continuous loop groove.

25. The system of claim 19, wherein the first member comprises a cabinet, and wherein the second member comprises a cabinet door.

26. The system of claim 19, wherein the first member comprises a cabinet door, and wherein the second member comprises a cabinet.

27. The system of claim 19, wherein the drive mechanism comprises a gas spring.

28. The system of claim 19, wherein the drive mechanism comprises a spring reel.

29. The system of claim 19, wherein the first member is a drawer.

30. The system of claim 19, wherein fastening means couple the lever arm to the body, and the toggle to the lever arm.

31. The system of claim 30, wherein the fastening means comprises rivets.

32. The system of claim 19, wherein the toggle and the tracing member are configured to inhibit a closed latch from, opening when an outward force is applied to the first member.

33. A latch comprising:

a body, wherein the body comprises a first member and a second member, wherein the first member comprises aluminum bronze;

a lever arm pivotally coupled to the body;

a toggle pivotally coupled to the lever arm;

a tracing member coupled to the toggle, said tracing member configured to couple the toggle to the body, wherein a portion of the tracing member is within a continuous loop path formed in the first member, and wherein the continuous loop path comprises at least a first position and a second position; and a torsion member coupled to the lever arm and to the body, the torsion member configured to rotate the lever arm away from the body;

wherein a closing force applied to the lever arm when the lever arm is in an open position rotates the lever arm toward the body and moves the portion of the tracing member in the continuous loop path away from the first position so that the portion of the tracing member in the continuous loop path moves to the second position when the closing force is removed from the lever arm.

34. The latch of claim 33, wherein an opening force applied to the lever arm when the lever arm is in a closed position rotates the lever arm toward the body and moves the portion of the tracing member in the continuous loop path away from the second position so that the portion of the tracing member in the continuous loop path moves to the first position when the opening force is removed from the lever arm.

35. The latch of claim 33, wherein the toggle and the tracing member are configured to inhibit the lever arm from rotating to the open position from the closed position when an outward force is applied to the lever arm.

36. The latch of claim 33, wherein the torsion member comprises a torsion spring.

37. The latch of claim 33, further comprising a roller rotationally coupled to the lever arm near an end of the lever arm.

38. The latch of claim 33, wherein fastening means couples the lever arm to the body.

39. The latch of claim 38, wherein the fastening means comprises a rivet.

40. The latch of claim 33, wherein the latch is a touch latch.

41. The latch of claim 33, wherein the latch i s a touch latch able to withstand an outward pulling force in excess of 90 pounds of force without releasing the latch from a closed position and without damaging the latch.

42. The latch of claim 33, wherein the latch is configured to inhibit the lever arm from rotating from a closed position to an open position when an outward force is applied to the lever arm even if the torsion member has failed.

43. The latch of claim 33, wherein the latch is configured to be used in an aircraft cabin.

44. A latch comprising:

a body, wherein the body comprises a first member and a second member;

a lever arm pivotally coupled to the body;

a toggle pivotally coupled to the lever arm, the toggle comprising a pin, wherein a portion of the pin is configured to fit within a closed-loop pathway formed in or coupled to the first member, wherein the closed-loop pathway comprises at least a first position and a second position, and wherein the pin is able to travel in the closed-loop pathway during use;

a member coupled to the lever arm and to the body, the member configured to rotate the lever arm away from the body;

a roller rotationally coupled to the lever arm near an end of the lever arm; and wherein a closing force applied to the lever arm when the lever arm is in an open position rotates the lever arm toward the body and moves the pin away from the first position so that the pin moves to the second position when the closing force is removed from the lever arm.

45. The latch of claim 44, wherein an opening force applied to the lever arm when the lever arm is in a closed position rotates the lever arm toward the body and moves the pin away from the second position so that the pin moves to the first position when the opening force is removed from the lever arm.

46. The latch of claim 44, wherein the toggle and the tracing member are configured to inhibit the lever arm from rotating to the open position from the closed position when an outward force is applied to the lever arm.

47. The latch of claim 44, further comprising a spring placed coupled to the fastening means between the toggle and the upper member of the lever arm.

48. The latch of claim 44, wherein the first member comprises aluminum bronze.

49. The latch of claim 44, wherein the torsion member comprises a torsion spring.

50. The latch of claim 44, wherein the latch is a touch latch.

51. The latch of claim 44, wherein the latch is a touch latch able to withstand an outward pulling force in excess of 90 pounds of force without releasing the latch from a closed position and without damaging the latch.

52. The latch of claim 44, wherein the latch is configured to inhibit the lever arm from rotating from a closed position to an open position when an outward force is applied to the lever arm even if the torsion member has failed.

53. The latch of claim 44, wherein the latch is a touch latch able to withstand an outward pulling force in excess of 90 pounds of force without releasing the latch from a closed position and without damaging the latch, and wherein the latch is configured to inhibit the lever arm from rotating from a closed position to an open position when an outward force is applied to the lever arm even if the torsion member has failed.

54. The latch of claim 44, wherein the latch is configured to be used in an aircraft cabin.

55. The latch of claim 44, wherein the latch is an aircraft cabin latch, and wherein the latch is configured to latch a storage device in an aircraft during use.

56. The latch of claim 44, wherein the latch is an aircraft cabin latch, wherein the latch is configured to latch a storage device in an aircraft during use, and wherein the latch is a touch latch.

57. The latch of claim 44, wherein the latch is an aircraft cabin latch, wherein the latch is configured to latch a storage device in an aircraft during use, and wherein the latch is a touch latch able to withstand an outward pulling force in excess of 90 pounds of force without releasing the latch from a closed position and without damaging the latch.

58. The latch of claim 44, wherein the latch is an aircraft cabin latch, and wherein the latch is configured to latch a storage device in an aircraft during use, and wherein the latch is configured to inhibit the lever arm from rotating from a closed position to an open position when an outward force is applied to the lever arm even if the torsion member has failed.

59. The latch of claim 44, wherein the latch is configured to latch a storage device in an aircraft during use, and wherein the latch is a touch latch able to withstand an outward pulling force in excess of 90 pounds of force without releasing the latch from a closed position and without damaging the latch, and wherein the latch is configured to inhibit the lever arm from rotating from a closed position to an open position when an outward force is applied to the lever arm even if the torsion member has failed.

60. A storage device comprising the latch of claim 44.

61. A storage device comprising the latch of claim 44, wherein the latch is configured to latch the storage device in an aircraft during use, and wherein the latch is a touch latch able to withstand an outward pulling force in excess of 90 pounds of force without releasing the latch from a closed position and without damaging the latch.

62. A storage device comprising the latch of claim 44, wherein the latch is configured to latch the storage device in an aircraft during use, and wherein the latch is configured to inhibit the lever arm from rotating from a closed position to an open position when an outward force is applied to the lever arm even if the torsion member has failed.

63. The latch of claim 44, wherein the latch is an aircraft cabin latch, and wherein the latch is configured to latch a cabinet in an aircraft during use.

64. A cabinet comprising the latch of claim 44.

65. A cabinet comprising the latch of claim 44, wherein the latch is configured to latch the cabinet in an aircraft during use, and wherein the latch is a touch latch able to withstand an outward pulling force in excess of 90 pounds of force without releasing the latch from a closed position and without damaging the latch.

66. A cabinet comprising the latch of claim 44, wherein the latch is configured to latch the cabinet in an aircraft during use, and wherein the latch is configured to inhibit the lever arm from rotating from a closed position to an open position when an outward force is applied to the lever arm even if the torsion member has failed.

67. The latch of claim 44, wherein the latch is an aircraft cabin latch, and wherein the latch is configured to latch a drawer system in an aircraft during use.

68. A drawer system comprising the latch of claim 44.

69. A drawer system comprising the latch of claim 44, wherein the latch is configured to latch the drawer system in an aircraft during use, and wherein the latch is a touch latch able to withstand an outward pulling force in excess of 90 pounds of force without releasing the latch from a closed position and without damaging the latch.

70. A drawer system comprising the latch of claim 44, wherein the latch is configured to latch the drawer system in an aircraft during use, and wherein the latch is configured to inhibit the lever arm from rotating from a closed position to an open position when an outward force is applied to the lever arm even if the torsion member has failed.

71. The latch of claim 44, wherein the latch is configured to be used in a boat cabin.

72. The latch of claim 44, wherein the latch is configured to be used in a boat cabin, wherein the latch is a touch latch able to withstand an outward pulling force in excess of 90 pounds of force without releasing the latch from a closed position and without damaging the latch.

73. The latch of claim 44, wherein the latch is configured to be used in a boat cabin, and wherein the latch is configured to inhibit the lever arm from rotating from a closed position to an open position when an outward force is applied to the lever arm even if the torsion member has failed.

74. The latch of claim 44, wherein the latch is configured to be used in a boat cabin, wherein the latch is a touch latch able to withstand an outward pulling force in excess of 90 pounds of force without releasing the latch from a closed position and without damaging the latch, and wherein the latch is configured to inhibit the lever arm from rotating from a closed position to an open position when an outward force is applied to the lever arm even if the torsion member has failed.

75. A touch latch comprising:

a body;

a path formed in or coupled to the body, the path having a first position and a second position;

a lever arm pivotally coupled to the body;

a toggle pivotally coupled to the lever arm;

a tracing member coupled to the toggle, said tracing member configured to couple the toggle to the body, and said tracing member configured to follow the path during use; and a torsion member coupled to the lever arm and to the body, the torsion member configured to rotate the lever arm away from the body;

a roller rotationally coupled to the lever arm near an end of the lever arm; and wherein a closing force applied to the lever arm when the lever arm is in an open position rotates the lever arm toward the body and moves the tracing member away from the first position so that the tracing member moves to the second position when the closing force is removed from the lever arm.

76. The touch latch of claim 75, wherein the touch latch is able to withstand an outward pulling force in excess of 90 pounds of force without releasing the touch latch from a closed position and without damaging the touch latch.

77. The touch latch of claim 75, wherein an opening force applied to the lever arm when the lever arm is in a closed position rotates the lever arm toward the body and moves the tracing member away from the second position so that the tracing member moves to the first position when the opening force is removed from the lever arm.

78. The touch latch of claim 75, wherein the toggle and the tracing member are configured to inhibit the lever arm from rotating to the open position from the closed position when an outward force is applied to the lever arm.

79. The touch latch of claim 75, wherein the torsion member comprises a torsion spring.

80. The latch of claim 75, wherein the touch latch able to withstand an outward pulling force in excess of 90 pounds of force without releasing the touch latch from a closed position and without damaging the touch latch, and wherein the touch latch is configured to inhibit the lever arm from rotating from a closed position to an open position when an outward force is applied to the lever arm even if the torsion member has failed.

81. The latch of claim 75, wherein the touch latch is configured to be used in an aircraft cabin.

82. A storage device comprising:

a latch comprising:

a body, wherein the body comprises a first member and a second member;

a lever arm pivotally coupled to the body;

a toggle pivotally coupled to the lever arm, the toggle comprising a pin, wherein a portion of the pin is configured to fit within a closed-loop pathway formed in or coupled to the first member, wherein the closed-loop pathway comprises at least a first position and a second position, and wherein the pin is able to travel in the closed-loop pathway during use;

a member coupled to the lever arm and to the body, the member configured to rotate the lever arm away from the body; and wherein a closing force applied to the lever arm when the lever arm is in an open position rotates the lever arm toward the body and moves the pin away from the first position so that the pin moves to the second position when the closing force is removed from the lever arm;

a platform, wherein the latch is configured to open and close the storage device, and wherein the platform can be raised to an open position when the latch is open.

83. The storage device of claim 82, further comprising a drive mechanism configured to raise the platform when the latch is open.

84. The storage device of claim 82, wherein an opening force applied to the lever arm when the lever arm is in a closed position rotates the lever arm toward the body and moves the pin away from the second position so that the pin moves to the first position when the opening force is removed from the lever arm.

85. The storage device of claim 82, wherein the toggle and the tracing member are configured to inhibit the lever arm from rotating to the open position from the closed position when an outward force is applied to the lever arm.

86. The storage device of claim 82, further comprising a spring placed coupled to the fastening means between the toggle and the upper member of the lever arm.

87. The storage device of claim 82, further comprising a roller rotationally coupled to the lever arm near an end of the lever arm.

88. The storage device of claim 82, wherein the first member comprises aluminum bronze.

89. The storage device of claim 82, wherein the torsion member comprises a torsion spring.

90. The storage device of claim 82, wherein the latch is a touch latch.

91. The storage device of claim 82, wherein the latch is a touch latch able to withstand an outward pulling force in excess of 90 pounds of force without releasing the latch from a closed position and without damaging the latch.

92. The storage device of claim 82, wherein the latch is configured to inhibit the lever arm from rotating from a closed position to an open position when an outward force is applied to the lever arm even if the torsion member has failed.

93. The storage device of claim 82, wherein the latch is a touch latch able to withstand an outward pulling force in excess of 90 pounds of force without releasing the latch from a closed position and without damaging the latch, and wherein the latch is configured to inhibit the lever arm from rotating from a closed position to an open position when an outward force is applied to the lever arm even if the torsion member has failed.

94. The storage device of claim 82, wherein the latch is an aircraft cabin latch, and wherein the latch is configured to latch the storage device in an aircraft during use.

95. The storage device of claim 82, wherein the latch is an aircraft cabin latch, wherein the latch is configured to latch the storage device in an aircraft during use, and wherein the latch is a touch latch.

96. The storage device of claim 82, wherein the latch is an aircraft cabin latch, wherein the latch is configured to latch the storage device in an aircraft during use, and wherein the latch is a touch latch able to withstand an outward pulling force in excess of 90 pounds of force without releasing the latch from a closed position and without damaging the latch.

97. The storage device of claim 83, wherein the latch is an aircraft cabin latch, and wherein the latch is configured to latch the storage device in an aircraft during use, and wherein the latch is configured to inhibit the lever arm from rotating from a closed position to an open position when an outward force is applied to the lever arm even if the torsion member has failed.

98. The storage device of claim 92, wherein the latch is configured to latch the storage device in an aircraft during use, and wherein the latch is a touch latch able to withstand an outward pulling force in excess of 90 pounds of force without releasing the latch from a closed position and without damaging the latch, and wherein the latch is configured to inhibit the lever arm from rotating from a closed position to an open position when an outward force is applied to the lever arm even if the torsion member has failed.

* * * * *

UNITED STATES PATENT AND TRADEMARK OFFICE

CERTIFICATE OF CORRECTION

PATENT NO. : 6,669,250 B1
DATED : December 30, 2003
INVENTOR(S) : Matthew St. Louis It is certified that error appears in the above-identified patent and that said Letters Patent is hereby corrected as shown below:

Column 13,
Line 26, please delete “i s a touch” and substitute therefor -- is a touch --.

Column 16,
Line 28, please delete “latch able” and substitute therefor -- latch is able --.

Column 18,
Line 17, please delete “claim 83” and substitute therefor -- claim 82 --.
Line 24, please delete “claim 92” and substitute therefor -- claim 82 --.

Signed and Sealed this

Eighteenth Day of May, 2004

JON W. DUDAS
*Acting Director of the United States Patent and Trademark Office*